United States Patent [19]

Leitner

[11] 4,176,699

[45] Dec. 4, 1979

[54] CHUCK FOR GRIPPING HEAD OF SCREW

[76] Inventor: Kajetan Leitner, Am Winacker, 8170 Bad Tölz, Fed. Rep. of Germany

[21] Appl. No.: 870,517

[22] Filed: Jan. 18, 1978

[30] Foreign Application Priority Data

Feb. 15, 1977 [GB] United Kingdom ..... 6193/77

[51] Int. Cl.[2] ..... B25B 23/10

[52] U.S. Cl. ..... 145/52; 144/32 R; 279/75

[58] Field of Search ..... 145/52; 144/32 R; 279/75, 74, 66, 82

[56] References Cited

U.S. PATENT DOCUMENTS

| | | | |
|---|---|---|---|
| 2,327,070 | 8/1943 | Snyder | 145/52 X |
| 2,840,126 | 6/1958 | Schmitt | 144/32 |

FOREIGN PATENT DOCUMENTS

| | | | |
|---|---|---|---|
| 372622 | 11/1963 | Switzerland | 144/32 |

*Primary Examiner*—Gil Weidenfeld

*Attorney, Agent, or Firm*—O'Brien and Marks

[57] ABSTRACT

A chuck for a hand or automatic tool has a shank adapted for torque-transmitting engagement with the head of a screw or like component which is to be inserted in a workpiece and a plurality of locking elements, such as balls, radially displaceable from an inoperative position to prevent inadvertent release of the component from the chuck.

4 Claims, 4 Drawing Figures

CHUCK FOR GRIPPING HEAD OF SCREW

This invention relates to a chuck which may be fitted to a hand tool or automatic tool, such as a screw-driving tool, to ensure that a component, such as a screw, is firmly held whilst being inserted in a workpiece.

According to this invention, a chuck for gripping the headed end of a screw or other component during rotative manipulation comprises a shank driving head through which in use torque is applied to the component, a carrier sleeve having a spring-balanced intermediate position on the head with an end near the component-engaging end of the head, the carrier sleeve having in it near that end a circumferentially-arranged series of radial bores, locking elements radially displaceable in the bores, and a locking sleeve slidable under a spring load on the carrier sleeve and adapted to control displacement of the locking elements in their bores, the arrangement being that in the intermediate position of the carrier sleeve, the head holds the locking elements in a radially-outermost position thereby to prevent sliding of the locking sleeve, and that, on manual sliding of the carrier sleeve to carry the locking elements beyond the component-engaging end of the head, the locking sleeve slides under its spring load to force the locking elements radially inwards to a component gripping setting.

Such a chuck is simple to operate manually when fitting a screw or like component into it, it merely being necessary to enter the driver blade or like into engagement with the head of the component and then to feed the carrier sleeve forward manually until the locking elements are freed to move inwards in front of the component head. The locking elements are conveniently balls.

In one particular form of the chuck, the shank has removably secured to it a head forming the component-engaging end of the shank and adapted to engage the component, whereby the head can be changed to handle different components. The head may be secured to the shank by a cross pin which with the locking sleeve removed can be exposed for removal through holes in the carrier sleeve by sliding it rearwards from the intermediate spring-balanced position.

In order to prevent loss of locking elements, such as the balls, if the carrier sleeve is fed forward without a screw or like engaged on the head, the number and size of the locking elements are conveniently selected so that they abut each other in their gripping position.

Other features of the chuck of this invention will appear from the following description by way of example of one embodiment applied to a manual screwdriver, the description making reference to the accompanying drawings, in which.

Figure 1:
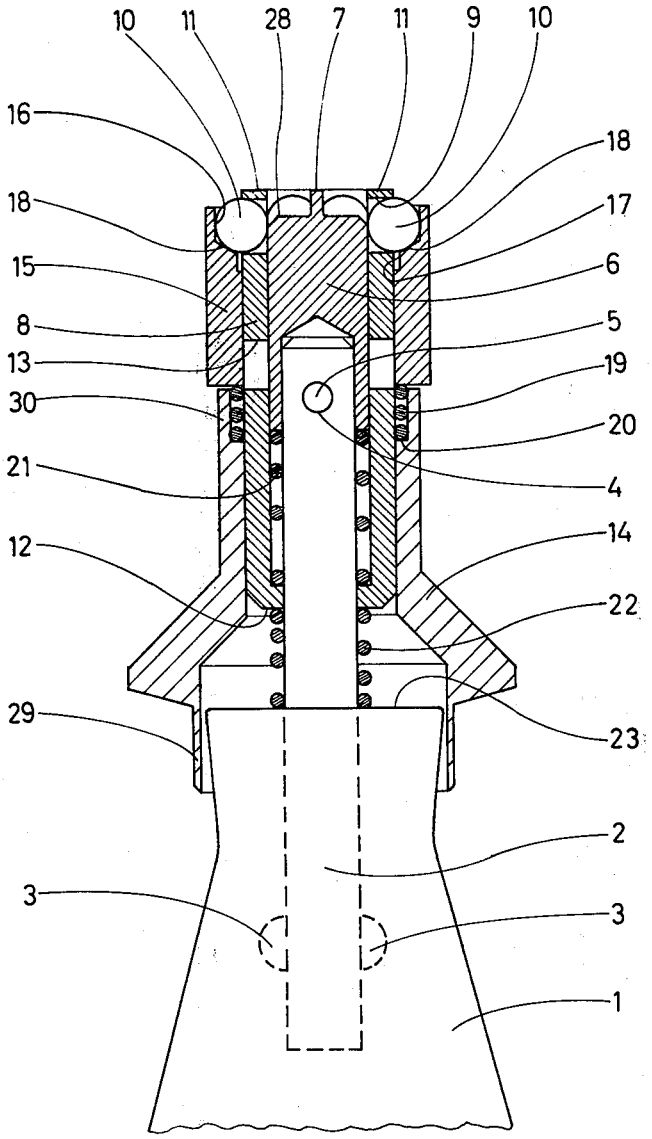
FIG. 1 is a section of the chuck as part of a screwdriver before a screw is fitted in position.

The tool with chuck as shown comprises a handle 1 in which is fitted a shank 2 secured against rotation. For this purpose, the shank has lateral protuberances 3 embedded in the material of the handle 1, for instance by the handle 1 being a synthetic plastics injection-moulding. The protruding portion of the shank 2 has near its forward end a transverse bore 4 to receive a cross pin 5 for securing a driving head 6 in position. The pin 5 provides a torque-transmitting connection between the shank 2 and the head 6.

Figure 2:
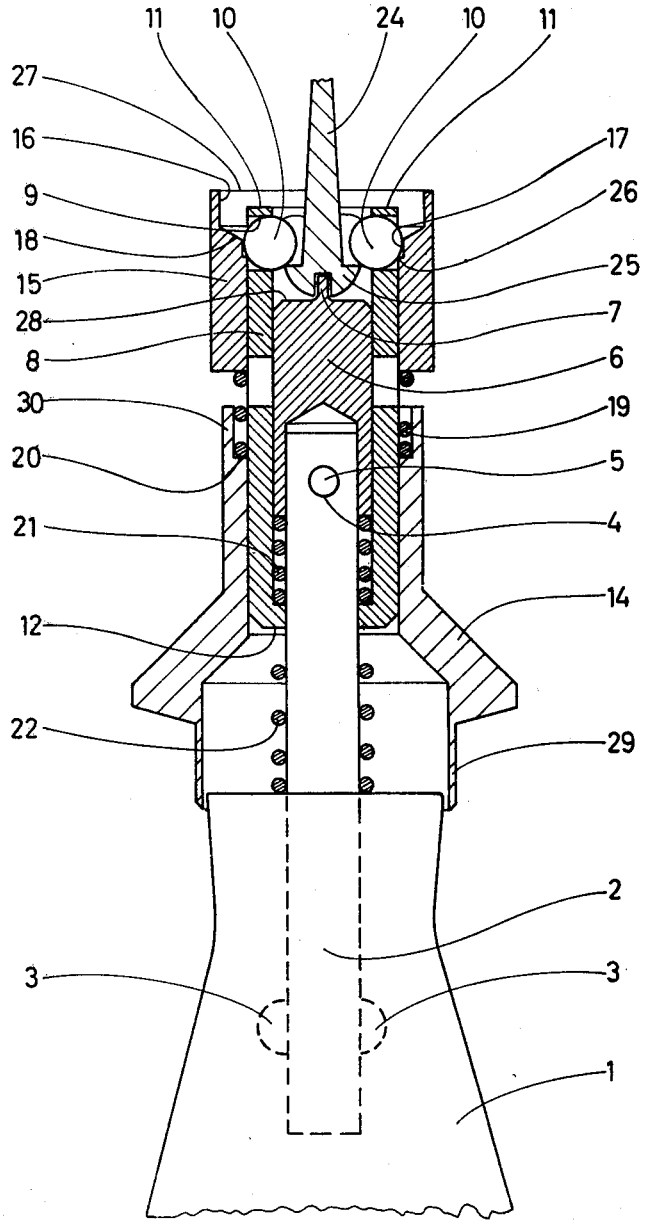
FIG. 2 shows the chuck with a screw in position.
Figure 3:
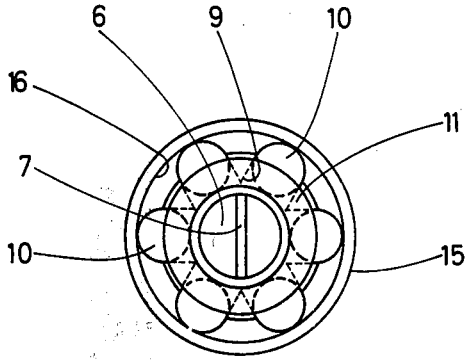
FIG. 3 is a view of the end of the chuck as shown in FIG. 1.

The form of the head 6 shown is such that the tool acts as a screw-driver and has at its forward end a blade 7 to engage the slot in the head 25 of a screw 24 (see FIG. 2). When the pin 5 is withdrawn from the bore 4, the head 6 can be removed and replaced by another, for example one with a cross blade for use with cross-headed screws.

The head 6 has slidably mounted on it a carrier sleeve 8 which has six equi-angularly-arranged radial bores 9 at its forward end, each bore 9 being occupied by a locking element, in this construction a ball 10. The bores 9 are separated from the front surface of the sleeve 8 by narrow webs 11. The bores 9 have such a diameter that the balls 10 can move radially with slight play in the bores 9.

The carrier sleeve 8 has an extension towards handle 1 beyond the head 6 and over the shank 2 and the extension has at its rear end an inward flange 12 slidably engaged on the shank 2. Approximately at its mid-length the carrier sleeve 8 has the diametrically aligned holes 13 which allow the pin 5 to be fitted and removed in a manner described below.

An operating sleeve 14 is firmly connected to the carrier sleeve 8 as by press fitting. Thus manual axial displacement of the operating sleeve 14 effects sliding of the sleeve 8 on the shank 2 with head 6.

A locking sleeve 15 is axially slidable on the sleeve 8. The locking sleeve 15 is internally stepped at its forward end to provide a larger diameter cylindrical zone 16 and smaller diameter cylindrical zone 17, these zones 16 and 17 being connected by a taper 18.

The locking sleeve 15 is urged forward by a compression spring 19 which bears by its ends against the rear end face of the locking sleeve 15 and against a shoulder 20 at the end of an annular recess internally of the operating sleeve 14.

The sleeve 8 is loaded in opposite directions by two springs 21, 22. The spring 21 bears by its ends against the rear end face of the head 6 and against the flange 12, and the spring 22 bears by its ends against the flange 12 and against the front face 23 of the handle 1. The springs 21 and 22 act against one another and are so selected as to their strengths that the sleeve 8 can take up a balanced intermediate position with its free end approximately level with the tip of the blade 7 (see FIG. 1).

When using the tool as described, a screw 24 has its head 25 engaged by the blade 7. Then whilst holding the screw, the operating sleeve 14 is pushed forwards so effecting sliding of the carrier sleeve 8 from its intermediate position on the shank 2 and head 6. The locking member 15 also partakes of this movement until the locking balls 10 clear the head 25 of the screw, whereupon the locking sleeve 15 is urged forwards by the spring 19 to force the balls 10 radially inwards to engage in front of the screw head 25. When the balls reach the limit of their inward movement they lie within zone 17 and are in the position as illustrated in FIG. 2 and the screw is clamped in position on the head 6.

The clamping action is the result of the load of the spring 21 urging the carrier sleeve 8 rearwards so that the balls 10 are drawn against the head 25 of the screw 24.

Figure 4:
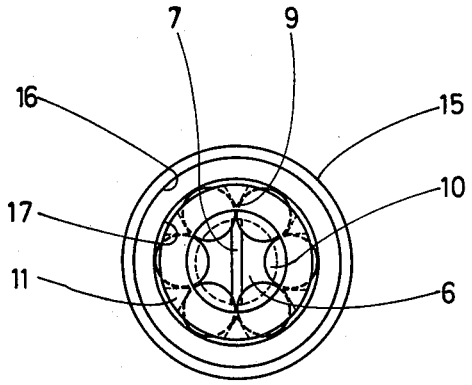
FIG. 4 is a view on the end of the chuck in the position of FIG. 2, but without the screw.

The locking sleeve 15 has adjacent zone 17 a shoulder 26 which protrudes inwards somewhat beyond the equators of the balls 10 when these lie against the zone 17 so limiting forward sliding of the locking sleeve 15 under the action of the spring 19. This is because the balls 10 cannot slide further radially inwards, their number and diameter having been so selected that in the position of FIGS. 2 and 4 they abut on one another (see FIG. 4).

In the position of FIG. 2, the spring 22 is completely relaxed and so has no effect on the relative positions of head 6 and carrier sleeve 8 which positions are determined by the screw head 25 and the balls 10 engaging it.

The screw 24 is thus held fast by the chuck and may be screwed into a workpiece. As the screwing-in operation proceeds, the end face 27 of the locking sleeve 15 will come into contact with the workpiece and thereafter the sleeve 15 is gradually pushed back as the screw 24 enters further into the workpiece, the spring 19 being thus compressed again. The locking sleeve 15 eventually reaches the position of FIG. 1 relatively to the carrier sleeve so that the balls 10 are urged outwards due to the sleeve 8 being moved rearwardly under the action of the expanding spring 21, so freeing the screw head 25. The screw 24 can thus be screwed fully into the workpiece by the head 6 moving to a position with the blade 7 projecting somewhat out of the chuck. This is possible because the handle 1, shank 2 and head 6 can be moved forwards relatively to the sleeve 8 with accompanying compression of the spring 22. This is especially important if countersunk screws are being inserted into the workpiece. As soon as manual pressure on the handle 1 is released, the parts return to the position of FIG. 1.

On release of the operating sleeve 14 if the parts have been moved to the position of FIG. 2 without a screw being inserted, the balls 10 will be forced outwards by the chamfered leading edge 28 of the head 6.

The operating sleeve 14 has at its rearward end a skirt 29 which serves to cover the gap between the end 23 of the handle 1 and the back of the operating sleeve 14 so preventing pinching of an operator's finger.

The operating sleeve 14 has a forward extension 30 to surround the spring 19 and to provide a stop limiting rearward movement of the locking sleeve 15 on the carrier sleeve 8. This prevents the balls 10 from falling out of the bores 9, for example by the locking sleeve being pushed back too far.

For assembly of the tool the following procedure may be adopted:

Firstly the spring 22 is threaded on to the shank 2 followed by the carrier sleeve 8, with sleeve 14 fitted on it, and spring 21 in that order. The selected head 6 is now fitted on to the shank 2. Next the spring 22 is compressed and the shank 2 is rotated to bring the bore 4 into alignment with the holes 13 in the sleeve 8. The cross pin 5 can now be inserted. Thus the shank 2 and the head 6 are firmly connected together. On release of the carrier sleeve 8 it takes up the intermediate position of FIG. 1 with the loads of springs 21, 22 balanced and with the pin 5 partially covered and thus prevented from falling out. The spring 19 is now fitted followed by the locking sleeve 15.

The locking balls 10 may now be inserted by pushing the carrier sleeve 8 forwards on the head 6 and shank 2 and at the same time pushing the locking sleeve 15 back to abut against the extension 30. Thus a position of the individual parts is similar to those of FIG. 1, except that the head 6 is retracted within the carrier sleeve sufficiently to expose the inner ends of the bores 9. The balls 10 which may now be inserted into the bores 9 are prevented from falling out of the outer ends of the bores by the locking sleeve 15. On release of the sleeves 8 and 15, all the parts take up the positions of FIG. 1.

Dismantling for example to change the head 6 takes place in the reverse order.

It should also be mentioned that in place of the handle 1 a known automatic drill can be provided, as has become known for automatic screw-drivers.

I claim:

1. A chuck for gripping the head of a screw (24) during rotation comprising a driving head (6) having an end (7) adapted to engage and impart rotation to the screw (24), a shank (2) having a forward end operatively connected to said head (6) for rotating the same, a carrier sleeve (8) slidably mounted lengthwise on said driving head (6) and on said shank (2), an operating sleeve (14) mounted on a rearward end of said carrier sleeve (8), first spring means (21) mounted in compression between said driving head (6) and said carrier sleeve (8) and urging said carrier sleeve (8) to an intermediate position in which an end of said carrier sleeve (8) is substantially level with the end (7) of said head (6), second spring means (22) carried by said shank (2) and loading said carrier sleeve (8) toward the end (7) of said head (6), a circumferentially arranged series of radial bores (9) located in said carrier sleeve (8) adjacent its forward end, a series of locking balls (10) received and radially displaceable in the series of bores (9), a locking sleeve (13) slidably disposed on said carrier sleeve (8), said locking sleeve (15) having internal cam surfaces (16, 17 and 18) to engage the urge the locking balls (10) inwards upon sliding of the locking sleeve (15) in a first direction to a forward end (11) of said carrier sleeve (8), and to release the locking balls (10) for outward displacement upon sliding of the locking sleeve (15) in an opposite direction, third spring means (19) mounted in compression between said locking sleeve (15) and said operating sleeve (14) and urging said locking sleeve (15) to move in the first direction, said head (6) engaging the locking balls (10) in the intermediate position of the carrier sleeve (8) to hold the locking balls (10) outwardly in their bores (9) thereby preventing sliding of the locking sleeve (15) in said one direction, and said carrier sleeve (8) and said locking sleeve (15) being movable together in said one direction to carry the locking balls (10) beyond the end (28) of the head (6) thereby freeing the locking sleeve (15) for movement in the one direction on the carrier sleeve (8).

2. A chuck as claimed in claim 1, wherein said driving head being releasable secured on the forward end of the shank.

3. A chuck as claimed in claim 2, comprising a cross pin extending through aligned holes in the head and the shank to secure them together, and said carrier sleeve having in it holes that can be aligned with the cross pin by sliding of the carrier sleeve from the intermediate position away from the head.

4. A chuck as claimed in claim 1, wherein the number and size of the locking balls are such that they abut each other when gripping a component.

* * * * *